United States Patent [19]

McGullion

[11] Patent Number: 4,757,838

[45] Date of Patent: Jul. 19, 1988

[54] FIRE HOSE REEL

[75] Inventor: Harold McGullion, Magnolia, Tex.

[73] Assignee: La Mc, Inc., Tomball, Tex.

[21] Appl. No.: 12,551

[22] Filed: Feb. 6, 1987

[51] Int. Cl.[4] ..... A62C 35/00; B65H 75/38

[52] U.S. Cl. ..... 137/355.27; 242/86

[58] Field of Search ..... 137/355.26, 355.27; 242/86

[56] References Cited

U.S. PATENT DOCUMENTS

| | | | |
|---|---|---|---|
| 289,960 | 12/1883 | Billings | 137/355.27 |
| 517,531 | 4/1894 | Casson | 137/355.26 |
| 538,950 | 5/1895 | Casson | 137/355.26 |
| 613,515 | 11/1898 | Howard | 137/355.26 |
| 1,675,140 | 6/1928 | Schenderlein | 242/86 |
| 1,799,599 | 4/1931 | Moore | 242/86 |
| 3,184,180 | 5/1965 | Rockwell | 242/86 |
| 3,433,247 | 3/1969 | Haselden | 137/355.26 |

*Primary Examiner*—A. Michael Chambers

*Attorney, Agent, or Firm*—William C. Norvell, Jr.

[57] ABSTRACT

An improved swivel fire hose reel is particularly suitable for use with fire safety equipment for industrial installations. A reel having a substantially vertical axis is pivotably mounted on a base, enabling the reel to rotate 360° and allow the hose to unwind at any desired angle with respect to the fire. A fluid inlet to the reel is affixed to the base, and a single fluid swivel joint enhances reliability and reduces cost of the reel assembly. An outer guard is mounted about rotatable with respect to the reel to further enhance safety and reliability.

12 Claims, 1 Drawing Sheet

FIRE HOSE REEL

FIELD OF THE INVENTION

The present invention relates to reels for storing a pliable fluid hose, and more particularly, to a fire hose reel particularly suitable for industrial applications.

BACKGROUND OF THE INVENTION

Various types of fire hose reels have been devised, including both fixed and rotatable reels commonly utilized in public facilities and generally positioned within a recessed fire hose cabinet. For industrial applications, the fire hose is often not collapsable, thereby enabling the hose to safely transmit higher fluid pressures. Moreover, the fire hose racks or hose reels for industrial applications frequently are free standing, so that the reel assembly can easily be affixed at a desired location to the floor at the industrial site.

With respect to general hose storage reels, U.S. Pat. No. 1,675,140 discloses a service station reel for supplying air or water to an automobile, with the reel mounted on a horizontal axis and pivotable about a base. U.S. Pat. No. 1,799,599 discloses a hose reel also having a horizontal reel axis and pivotable about a foundation. U.S. Pat. No. 3,184,180 discloses a garden hose reel similarly having a horizontal axis, and including a support member designed to be pivotably stuck into the ground.

Industrial fire hose reels having horizontal axes are manufactured by Herbert S. Hiller Corporation and Magnum Fire & Safety Systems. These prior art reels may be positioned at an industrial site, and provide a suitable rack for the fire hose. The units include a fluid inlet generally affixed adjacent the reel and aligned with the axis of the reel. These units are not, however, pivotably mounted on a stationary base, and thus problems can arise when the hose is pulled off the reel in a direction other than that perpendicular to the axis of the reel.

Prior art industrial fire hose reels generally must be operated by at least two people. Considerable time is utilized to unreel the hose from the reel, then direct the nozzle of the hose to the fire. If the hose is hastily unwound, as can be expected during an emergency, the hose of prior art reels frequently becomes snagged at a location adjacent the base of the reel, thereby delaying critical time before a fire can be brought under control. Even if a hose reel is mounted on a swivel base, the inlet to the reel would rotate as the reel rotates, thereby enhancing the likelihood that the fluid conduit to the reel assembly will substantially restrict the ability of the reel to freely swivel upon a base, or that the incoming fluid line will become snagged, thereby restricting fluid flow to the reel and the fire. Also, prior art industrial reel assemblies are expensive to manufacture, and component parts cannot be easily repaired or replaced. Finally, it is difficult for one person to unwind the hose from the reel during an emergency, and also to rewind the hose back on the reel after use.

The disadvantages of the prior art are overcome by the present invention, and an improved fire hose reel assembly is hereinafter described having significant advantages over prior art reels.

SUMMARY OF THE INVENTION

The reel assembly of the present invention includes a reel body having a substantially vertical axis, with the reel body being rotatable to allow the hose to easily unwind and rewind on the reel. The reel body is mounted on a 360° swivel attached to a reel base, so that the reel can swivel to any position as the hose is pulled off the reel in the direction of a fire.

Fluid to the hose on the reel assembly is supplied through a fluid inlet affixed to the assembly base, so that the inlet and incoming fluid line do not move as the reel swivels about its base. A single swivel thus reduces manufacturing costs yet provides increased safety by substantially decreasing the likelihood that either the incoming fluid line or the hose from the assembly will be snagged on a component as the operator pulls the hose from the reel.

An outer guard is provided to protect the hose while on the reel, and also acts to prevent any portion of the hose from falling about the base as the hose is unwound. The guard is rotatably mounted to the reel, but is not affixed to the base. Spaced vertical posts of the guard and its circular base prevent the hose from dropping between the guard and the base of the reel assembly. This arrangement also facilitates single operator rewind of the hose, since ready access to the reel is available from any circumferential location.

These and further features and advantages of the present invention will become apparent from the following detailed description, wherein reference is made to the figures in the accompanying drawing.

DETAILED DESCRIPTION OF THE PREFERRED EMBODIMENT

Figure 1:
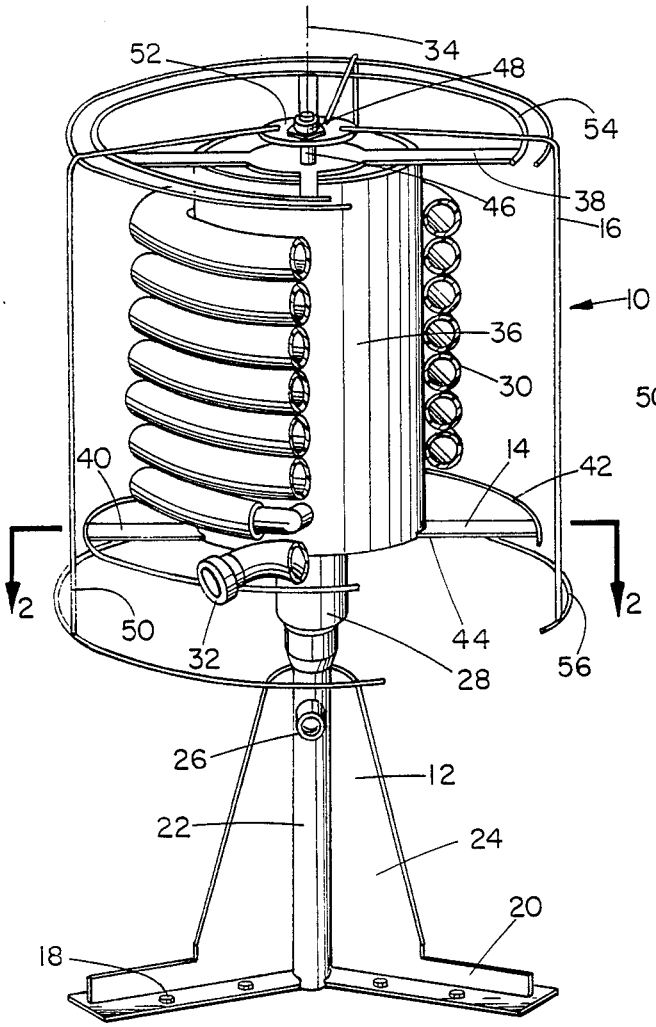
FIG. 1 is a pictorial view, partially in cross-section, of an improved fire hose rack according to the present invention.

FIG. 1 depicts a fire hose rack assembly 10 of the present invention, comprising a base 12, a fire hose reel 14 used in various industrial environments, such as a petrochemical plant, an offshore oilwell, or manufacturing facility, for fire prevention and/or control. The unit shown in FIG. 1 includes a conventional industrial strength water hose, although the unit of the present invention can be used for transmitting various fire control materials, such as dry chemicals, to a fire.

The assembly 10 shown in FIG. 1 may be fixedly positioned at any desired location, and accordingly a plurality of bolts 18 are provided in apertures located in the angle iron frame members 20. A vertical support pipe 22 is welded to members 20 by a plurality of gussett plates 24. Nipple 26 is welded to the pipe 22, and transmits water to the swivel joint 28 and then to the hose 30 having an end nozzle 32.

As explained further below, the fire hose reel 14 is fixedly mounted to the upper portion of swivel 28, and is thus free to rotate in any direction about the vertical axis 34 of the assembly. Reel 14 comprises a central hub 36 for receiving the coiled hose, and identical upper and lower planar hub ends 38 and 40, respectively. Each hose end is formed from a ring-shaped rod 42 secured to the hub 36 by the plurality of circumferentially spaced hose support members 44.

A pin 46 is affixed to and extends upwardly from the reel 14, with the guard 16 rotatably mounted to pin 46 by bearing assembly 48. The guard 16 comprises a plurality of inverted L-shaped rod members 50 each secured to a flange 52 extending from the bearing assembly 48, an upper ring-shaped rod member 54 secured adjacent the corner of each member 50 for stability, and a lower ring member 56 secured to the lower end of each member 50 also provided for stability of the guard. Thus the guard 16 may rotate about the axis 34 with respect to the reel 14, which in turn is free to rotate about the same axis with respect to the base.

Except for the hose, all components described above may be fabricated from a suitable metal. If a corrosive of atmosphere is expected, such as may be anticipated in an offshore oil well, the unit may be hot dipped galvanized or otherwise coated with an epoxy material to minimize corrosion.

Bearing assembly 48 may consist of a plurality of vertically spaced bearings, so that the axial alignment of the guard relative to the reel remains sufficiently fixed to prevent undue wobble. A suitable grease fitting (not shown) may be provided for lubricating the bearing assembly to facilitate ease of rotation.

Figure 2:
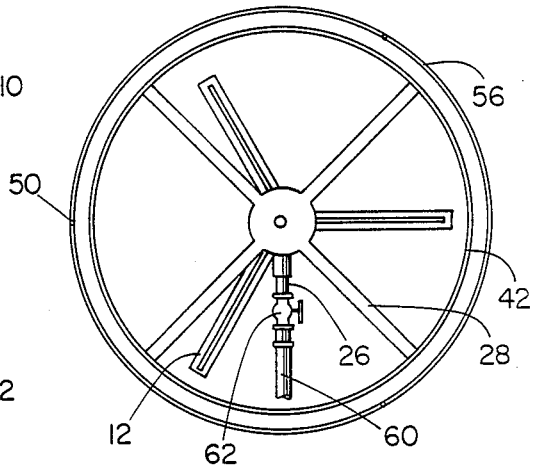
FIG. 2 is a cross-sectional view of the fire hose rack depicted in FIG. 1.

Referring now to FIG. 2, it should be understood that the base 12 may be affixed at any desired location to the floor at any angular position, preferably one which facilitates connection of the incoming water line 60 to nipple 26. A suitable valve 62 may be connected directly to the nipple 26 to control fluid flow to the assembly 10. Since the base 10 is fixed, angular rotation of the reel will have no affect on the position of the incoming water line 60, and accordingly the incoming water line will not become snagged or otherwise prevent rotation of the reel during use of the assembly.

When in storage, the free end of the hose may be fully supported by the reel and, more particularly, the combination of lower hose supports 48 and ring 42. When the hose is pulled off the reel, the reel will rotate and, depending upon the angle of the fire relative to the reel, the guard 16 may also rotate slightly relative to the base 12. Most importantly, any slack in the hose is prevented by the guard from falling about the base of the assembly and becoming snagged, since the radial space between rod 42 and each of the inverted L-shaped members 50 is less than the diameter of the hose. Although a portion of the hose could conceivably fall toward the ground between two circumferentially spaced members 50, the hose 50 is sufficiently inelastic to minimize that possibility. Moreover, even should the hose drop slightly below ring 42, continued pull will "take up" this slack and the hose will not become snagged about the base 12. Also, if the desired direction of the hose nozzle relative to the assembly should change at any time due, for example, to a change in the location of the fire, both the reel 14 and the guard 16 are free to rotate to assist this movement.

Figure 3:
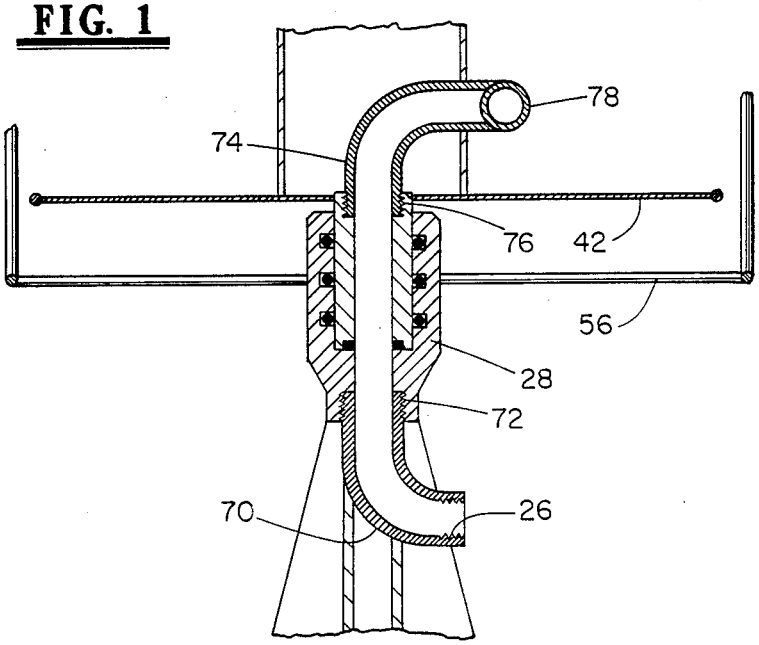
FIG. 3 is a side view, partially in cross-section, of a portion of the fire hose rack shown in FIG. 1.

Referring now to FIG. 3, a slow 90° elbow 70 may be welded to pipe 22, with the nipple end 26 extending outwardly as shown to facilitate connection with a valve or incoming flow line. The upper end of elbow 70 is threaded at 72 for connection with the swivel joint 28. The swivel joint 28 is shown only generally in FIG. 3, since the unit may be one of various types commercially available swivel joints, such as the Style 20, Chikson ®2 inch swivel joint available from FMC Corp. It should be noted, of course, that swivel joint 28 transmits fluid from the nipple 26 to the hose, while allowing the reel to rotate freely about its vertical axis.

Another slow 90° elbow 74 is threaded at 76 to the upper portion of the swivel joint 28. A suitable connection, such as threads or a fluid-type clamp (not shown) may be utilized to interconnect the end 78 of elbow 74 with the hose according to conventional techniques. Ring 56 is not connected to the swivel 28 or the base 12, while ring 42 is suitably connected by welding to elbow 74 via supports 44.

The fire hose reel assembly of the present invention has significant advantages over prior art reels. Since the reel itself not only rotates, but may be swiveled about a vertical axis, the hose can more easily be pulled off the reel in the direction of a fire. A fire hose reel which would swivel about a base but have a horizontal axis would likely require three rotatable connections: one connection to enable to horizontal reel to swivel about a reel base, and one connection at each end of the horizontal reel axis to support the reel and the weight of the hose. Applicant only requires a single swivel connection, thereby substantially reducing the complexity of the assembly and thus manufacturing and maintenance costs.

Applicant also preferably affixes the fluid inlet to the assembly at the fixed base of the assembly, and transmits fluid to the hose through the swivel connection. This feature enables the reel to freely swivel without regard to the position of the incoming fluid line to the assembly, thereby reducing the likelihood that the incoming fluid line will become snagged or otherwise restrict swiveling of the reel as the unit is used.

The structural components of Applicant's apparatus are readily available and repair and replacement of a swivel is facilitated since the swivel is threaded at its lower and upper ends, respectively, to the elbow 70 and the elbow 74 affixed to the reel. If desired, thread 76 may thus be easily broken, the reel removed, the thread 72 broken, and the swivel replaced.

As a feature of the invention, Applicant provides a guard ring having one or more legs which extend from above to below the reel, and are radially positioned outwardly from the lower reel face at a location which prevents the hose from falling between the end of the reel face and the guard leg. The guard rotates relative to the reel about the same vertical axis as the rotatable reel, and functions to protect the hose when on the reel while enhancing the safe unwinding and rewinding of the hose on the reel.

It should be understood that the unit shown in FIGS. 1 through 3 will generally be connected to a source of fire control fluid, such as water, and valve 62 normally turned off. Should a fire occur, a single operator may grasp the hose nozzle, turn on the valve, and immediately proceed with the nozzle in the direction of the fire. As the operator moves toward the fire, the outgoing hose will be "live" since water can pass through the hose while all or any portion of the hose is still on the reel. Regardless of the position of the fire relative to the assembly, the swivel enables the reel to both rotate and keep the "line" of the outgoing hose generally perpendicular to the axis of the reel. The guard may also rotate, and prevents the hose from becoming snagged about the assembly base. Should the position of the fire relative to the assembly change, the operator may easily move to the new location without regard for the angle of the outgoing hose relative to the reel.

After the fire is brought under control, the valve may be turned off and the water bled from the hose. An operator may then reach between the spaced vertical members 50 and rotate the reel 14 with one hand while guiding the hose with the other hand so that the hose is neatly wound back on the reel. This rewind operation can thus also be easily performed by a single operator.

The assembly of the present invention may be manufactured in various sizes depending upon the desired capacity of the hose to be installed on the reel. A typical unit for accommodating 200 feet of 1½ inch hose may have a height of approximately 63 inches and an overall diameter of approximately 26 inches.

The reel assembly of the present invention is designed for use with fire hose in an industrial environment. The concepts of the present invention may be used for transmitting various fluids from a source to a desired location. A suitably sized unit could thus be used for irrigation purposes, or to intermittently provide air, water, or grease from a central location to various machines positioned at a site. An automatic rewind mechanism may be included to facilitate rewinding of the hose, according to conventional techniques.

These and further features and advantages of the present invention should now be apparent to those with ordinary skill in the art. Accordingly, the embodiments described herein and shown in the accompanying drawings are provided for illustration only, and the invention should not be understood as being limited to such embodiments.

What is claimed and desired to be secured by Letters Patent is:

1. A fire hose reel assembly for supporting a fire hose and for transmitting a fire control fluid from a source to the hose, the assembly comprising:

a base fixedly positionable at a selected location and having a center vertical support;

a reel supported by the base for receiving the fire hose wound about the reel and having a vertical reel axis substantially aligned with the center vertical support of the base;

a fluid inlet affixed to the base for connection with the source of fire control fluid;

a swivel joint between the base and the reel for allowing the reel to rotate relative to the base while transmitting the fire control fluid from the fluid inlet through the swivel joint and to the hose;

a plurality of guard rods each rotatable with respect to the reel and extending from above the reel to below the reel and mounted radially outward from the reel, the guard rods being circumferentially positioned about the perimeter of the reel such that an unwound end of the hose can be fed between any two of the guard rods; and an annular guard ring interconnected with lower portions of each of the plurality of guard rods and axially spaced between the reel and the base, the guard ring maintaining a spacing between each of the guard rods and the perimeter of the reel less than the diameter of the fire hose for preventing an unwound portion of the hose from becoming entangles with the base.

2. The assembly as defined in claim 1, wherein the reel guard is rotatably mounted to a rod extending upwardly from the reel.

3. The assembly as defined in claim 1, wherein the swivel joint is removably connected at one end to the base and is removably connected at the other end to the reel.

4. The assembly as defined in claim 1, further comprising:

a lower elbow fixedly secured to the base and having an inlet end forming the fluid inlet and a lower swivel joint end for fluid-tight connection to the swivel joint; and an upper elbow fixedly secured to the reel and having an upper swivel joint end for fluid-tight connection to the swivel joint and a hose connection end for fluid-tight connection to the hose.

5. A hose reel assembly for supporting a hose and for intermittently transmitting a fluid from a source to a desired location, the assembly comprising:

a base fixedly positioned at a selected location;

a reel supported by the base for receiving the hose wound about the reel and having a substantially vertical reel axis aligned with the base;

a fluid inlet affixed to the base for connection with the source of fluid;

a swivel joint between the base and the reel for allowing the reel to rotate relative to the base while transmitting fluid from the fluid inlet through the swivel joint to the hose;

a plurality of guard rods each rotatable mounted about the reel and extending from above the reel to below the reel and radially outwardly from the reel, the guard rods being circumferentially positioned about the perimeter of the reel a distance substantially greater than the diameter of the hose such that an unwound end of the hose can be fed between any two of the guard rods; and a circular guard ring supported by the plurality of guard rods and mounted axially between the reel and the base and radially outward of the base, the guard ring maintaining a spacing between each of the guard rods and the perimeter of the reel less than the diameter of the fire hose for preventing an unwound portion of the hose from becoming entangled with the base.

6. The assembly as defined in claim 5, wherein the reel guard rotates about an axis substantially aligned with the vertical reel axis; and the reel guard is rotatably mounted to a rod extending upward from the reel.

7. The assembly as defined in claim 5, wherein the swivel joint is removably connected at one end to the base and is removably connected at the other end to the reel.

8. The assembly as defined in claim 5, further comprising:

a lower elbow fixedly secured to the base having an inlet end forming the fluid inlet and a lower swivel joint end for fluid-tight connection to the swivel joint; and an upper elbow fixedly secured to the reel and having an upper swivel joint end for fluid-tight connection to the swivel joint and a hose connection end for fluid-tight connection to the hose.

9. In a fire hose reel assembly for supporting a fire hose and for transmitting a fire control fluid from a source to the hose, the assembly including a base fixedly positionable at a selected location and a fluid inlet affixed to the base for connection with the source of fire control fluid, an improved reel assembly comprising:

a reel supported by the base for receiving the fire hose wound about the reel and having a substantially vertical reel axis aligned with the base, a swivel joint positionable between the base and the reel for transmitting a fire control fluid from the fluid inlet through the swivel joint and to the hose;

the reel being mounted to the swivel such that the reel has a substantially vertical axis enabling the reel to rotate relative to the base;

a plurality of guard rods each rotatable with respect to the reel and extending from above the reel to below the reel and mounted radially outwardly from the perimeter of the reel; and an annular guard ring fixedly interconnected with lower portions of each of the guard rods for maintaining a spacing between each of the guard rods and the perimeter of the reel less than the diameter of the fire hose for preventing an unwound portion of the hose from becoming entangled with the base.

10. The assembly as defined in claim 9, wherein the reel guard is rotatably mounted to a rod extending upwardly from the reel.

11. The assembly as defined in claim 9, wherein the swivel joint is removably connected at one end to the base and is removably connected at the other end to the reel.

12. The assembly as defined in claim 9, further comprising:

a lower elbow fixedly secured to the base and having an inlet end forming the fluid inlet and a lower swivel joint end for fluid-tight connection to the swivel joint; and an upper elbow fixedly secured to the reel and having an upper swivel joint end for fluid-tight connection to the swivel joint and a hose connection end for fluid-tight connection to the hose.

* * * * *